US007722321B2

(12) United States Patent
Lhoest et al.

(10) Patent No.: US 7,722,321 B2
(45) Date of Patent: May 25, 2010

(54) TURBO-ENGINE STATOR BLADING, TURBO-ENGINE COMPRISING THE BLADING AND TURBO-ENGINE BLADE

(75) Inventors: Andre Lhoest, Huy (BE); Georges Broers, Hoeselt (BE); Thomas Colmant, Braives (BE); Georges Duchaine, Warsage (BE); Xavier Wery, Liege (BE)

(73) Assignee: Techspace Aero, Herstal Milmort (BE)

( * ) Notice: Subject to any disclaimer, the term of this patent is extended or adjusted under 35 U.S.C. 154(b) by 639 days.

(21) Appl. No.: 11/613,473

(22) Filed: Dec. 20, 2006

(65) Prior Publication Data

US 2007/0147993 A1 Jun. 28, 2007

(30) Foreign Application Priority Data

Dec. 22, 2005 (EP) ..... 05112843

(51) Int. Cl.
*F04D 29/44* (2006.01)

(52) U.S. Cl. ..... 415/209.3; 416/219 R

(58) Field of Classification Search ..... 415/209.3, 415/209.4, 210.1; 416/214 R, 214 A, 219 R; 29/889.2, 889.21, 889.22
See application file for complete search history.

(56) References Cited

U.S. PATENT DOCUMENTS

| | | | | |
|---|---|---|---|---|
| 2,755,064 A | | 7/1956 | Simonsen | |
| 2,957,228 A | * | 10/1960 | Stoddard et al. | 29/889.22 |
| 3,112,916 A | | 12/1963 | Miller, Jr. et al. | |
| 3,511,577 A | | 5/1970 | Karstensen | |
| 4,594,761 A | | 6/1986 | Murphy et al. | |
| 4,832,568 A | | 5/1989 | Roth et al. | |
| 4,940,386 A | | 7/1990 | Feuvrier et al. | |
| 2006/0133929 A1 | * | 6/2006 | Miller et al. | 415/191 |

FOREIGN PATENT DOCUMENTS

| | | |
|---|---|---|
| DE | 1 200 070 | 9/1965 |
| EP | 0 353 498 A2 | 2/1990 |
| FR | 2 321 616 | 3/1977 |
| GB | 599391 | 3/1948 |
| GB | 790280 | 2/1958 |
| GB | 960812 | 6/1964 |
| GB | 1 208 507 | 10/1970 |
| JP | 59-180006 | 10/1984 |

* cited by examiner

*Primary Examiner*—Edward Look
*Assistant Examiner*—Dwayne J White
(74) *Attorney, Agent, or Firm*—Oblon, Spivak, McClelland, Maier & Neustadt, L.L.P.

(57) ABSTRACT

A turbo-engine stator blading is disclosed. The turbo-engine stator blading includes a crown of fixed blades mounted on a ring. Each blade includes a platform and each blade is fastened to the ring. The ring includes a plurality of individual receptacles for the each of the platforms, the receptacles being machined in the thickness of the ring, the form of each receptacle being complementary to that of the corresponding platform. By means of the receptacles, the mounting of the blades within the blading is both simple and accurate.

15 Claims, 1 Drawing Sheet

TURBO-ENGINE STATOR BLADING, TURBO-ENGINE COMPRISING THE BLADING AND TURBO-ENGINE BLADE

BACKGROUND OF THE INVENTION

The invention relates to the field of turbo-engines comprising stator blading.

A turbo-engine, whether it be a compressor, a turbine or any other engine, such as a turbojet, comprising at least one stator blading. By stator blading is meant a set of fixed blades mounted in the form of a crown on an outer ring and/or an inner ring. As an example, mention may be made of flow-straightening bladings in compressors or turbines, generally arranged between two moving-blade stages, or else flow-straightening bladings placed just downstream of the blower in double-flow turbojets.

The blades of some axial stator bladings are oriented differently, depending on their angular position, in order to adapt the flow which they guide to the aerodynamic constraints of the engine.

Various forms of fastening of the blades on the outer ring of the blading are known. In document EP 0,953,729, each blade, inserted in a bore of the inner ring, comprising an outer platform which is slipped into a circumferential groove of the outer ring and is fastened to the latter by means of rivets. The outer platforms may comprise chamfers or notches allowing them to be interlocked with one another. In document U.S. Pat. No. 6,371,725, the blades comprise an outer platform having outer bosses for receiving a screw; the platforms are laid against one another, thus delimiting the corresponding portion of the flow section, and are fastened to the stator by means of screws inserted in the bosses.

Such bladings have the disadvantage of being difficult to mount, since the blade platforms delimiting the flow section must be perfectly contiguous. Moreover, in the event that the orientation of the blades differs according to their angular position, this mounting is all the more difficult because it is then necessary to provide blades which are of different forms and/or the platforms of which are different, which have to be mounted in succession in the correct order.

The present invention aims to propose a stator blading for which the mounting of the blades is both simple and accurate.

BRIEF SUMMARY OF THE INVENTION

According to the invention, the stator blading of the turbo-engine comprises a crown of fixed blades mounted on a ring, each blade comprising a platform intended to be fastened to the ring, characterized in that the ring comprises a plurality of individual receptacles for the platforms, the said receptacles being machined in the thickness of the ring, the form of each receptacle being complementary to that of the corresponding platform.

By virtue of the invention, each blade is placed in the blading by its platform being inserted into a receptacle of complementary form. Mounting is thus very simple to carry out, without the risk of error. Since the receptacles are obtained by machining, any human error is avoided, since the mounting accuracy of the blading is ensured by the precision of the machines used for forming the receptacles and platforms, independently of the mounting operation itself. Moreover, as well as, of course, the platforms, it is the ring which delimits the corresponding portion of the flow section: the leak-tightness of the assembly is thus ensured, its rigidity, moreover, being increased.

In the event that the blades are oriented differently from one another according to their angular position in the blading, the receptacles make it possible both to position and to orient the blades within the blading.

According to a highly advantageous embodiment, all the blades are identical and their orientation in the blading is determined by the orientation of each receptacle. Thus, each receptacle is formed on the ring according to the desired orientation of the blade, the platform of which it accommodates. In such an embodiment, by means of identical blades, a blading is obtained which has blades of different orientation, according to the position about the axis of the engine, simply by virtue of the orientation imparted to the receptacles. The mounting of such blading is extremely simple in as much as a single type of blade is used.

Preferably, the individual receptacles are recesses with a flat bottom.

Also preferably, the platforms of the blades comprise a threaded rod which is designed to be inserted into a bore issuing on the surface of the bottom of the corresponding recess and which is bolted to the ring. The advantage of such an embodiment is that it is not necessary for the platforms to have a substantial thickness or to comprise bosses in order to make it possible to insert within them screws attached from outside the ring. A saving is thus made in terms of the thickness of the platforms and consequently in terms of the dimensions and weight of that part of the turbo-engine which comprises the blading.

Preferably, in this case, the platforms comprise a recessed surface portion around the threaded rod, thus giving rise to uniform contact on the outer edges of the platform, not around the threaded rod; corrosion by fretting or friction (usually designated as fretting corrosion) is thereby greatly reduced.

Advantageously, in this case, the recessed surface portion is of circular form. Such a portion may be obtained by the lathe-turning of the platforms, thus entailing a low manufacturing cost and ensuring high machining accuracy.

Advantageously, the blades are in one piece with their platform. This results in much greater simplicity in manufacturing terms and a higher rigidity of the blades.

It may be noted that, within the scope of the invention, the blades may be fastened on the opposite side to the ring in any way. Mounting accuracy on the side of the ring allows the use of any means of positioning and fastening on the other side: platforms inserted in a groove, bores for the insertion of the end of the blades, platforms accommodated in receptacles similar to those of the ring, end of the blades in suspension, etc.

In may be noted that the invention also applies to blading structures in which the blades are different from one another, but their platforms are all identical and easy to mount in their respective receptacles. The platforms may likewise be different, and it is then easy to determine the position of each blade according to the form of the receptacle corresponding to its platform; a correct assignment of the platforms, as it were, is obtained by means of the receptacles.

The invention also relates to a turbo-engine comprising a stator blading, as described above.

The invention relates, further, to a blade for a turbo-engine, comprising a blade body supporting a platform with a threaded rod projecting from its surface, characterized in that the platform is in the form of a plate of substantially constant thickness.

BRIEF DESCRIPTION OF THE DRAWINGS

The invention will be understood more clearly from the following description of the preferred embodiment of the blading of the invention, with reference to the accompanying plate of drawings in which.

DETAILED DESCRIPTION OF THE INVENTION

Figure 1:
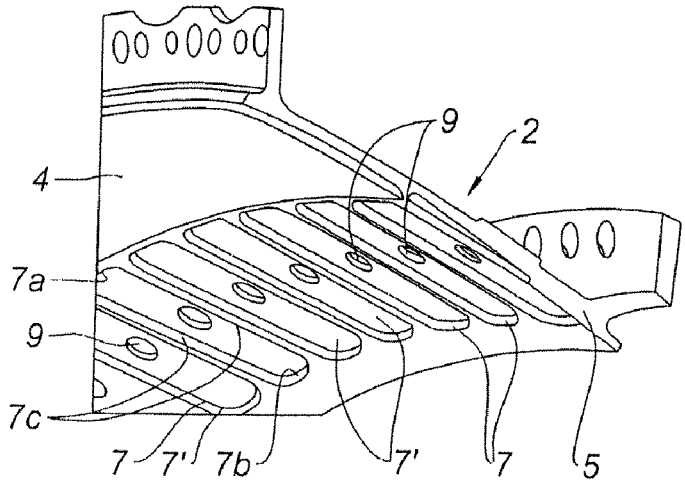
FIG. 1 illustrates a partial diagrammatic perspective view, seen from the inside, of the outer ring of the preferred embodiment of the stator blading of the invention, without the blades.
Figure 2:
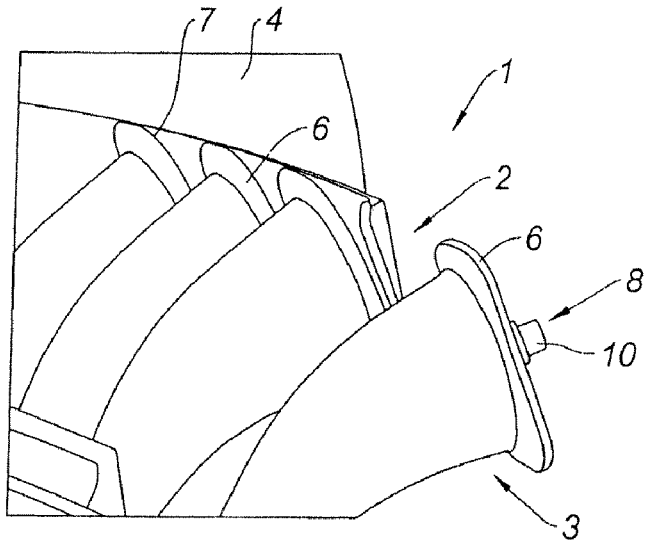
FIG. 2 illustrates a partial diagrammatic perspective view, seen from the inside, of the preferred embodiment of the stator blading of the invention.

Referring to FIGS. 1 and 2, the axial stator blading 1 of the invention comprises a ring 2, in this particular case an outer ring, and blades 3 mounted fixedly on the ring 2. By axial blading is meant a blading which extends within an axially flowing gas stream and the blades of which extend substantially perpendicularly with respect to the direction of flow of the stream. Where fixed blades are concerned, these are generally referred to as bolted blades. In this particular case, the stator blading 1 is a straightener blading located in the lower-pressure compressor of a turbojet. FIGS. 1 and 2 show the zone 4 of abraidable material which is located upstream of the straightener blades 3 with which the moving blades of the preceding rotor stage of the compressor are intended to fit closely. It will be recalled that the invention applies more generally to any stator blading comprising fixed blades mounted on a generally outer ring.

For the ring 2 comprises a wall 5 of revolution, here of substantially cylindrical form, for supporting the blades 3. Each blade 3 comprises, here on the outside of its blade body 3', a platform 6, in a known way. The platforms 6 are preferably formed in one piece with the blades 3. Their form is in this particular case relatively simple, in the shape of a rectangle with rounded angles. All the platforms 6 are preferably identical.

The ring 2 comprises a plurality of individual receptacles 7 for the platforms 6 of the blades 3. Each receptacle 7 is intended for accommodating a platform 6. It is of a form complementary to that of this platform 6. The receptacles 7 are machined in the thickness of the wall 5 of the ring 2, here on the inside of the latter.

In general terms, the receptacles 7 comprise an upstream edge 7*a*, a downstream edge 7*b* and two lateral edges 7*c*. The orientation of the lateral edges 7*c* with respect to the axis of the turbojet gives the blades 3 their orientation. The lateral edges 7*c* of two adjacent receptacles 7 are separate. In other words, the receptacles 7 do not comprise common edges, and, between each receptacle 7, a surface portion of the ring 2 extends. Leak-tightness from one receptacle to another is therefore ensured by the ring 2 itself, not by the platforms 6 of the blades 3.

According to a preferred embodiment, the receptacles 7 are in the form of recesses 7 with a flat bottom 7'. This is the simplest and most compact structure. The recesses 7 comprise a circumferential wall in the form of the platforms 6, that is to say, here, rectangular with rounded angles, and with a height, from the flat bottom 7', which is equal to the thickness of the platforms 6. The platforms 6 are in the form of a plate of substantially constant thickness; these are therefore flat platforms 6.

Figure 3:
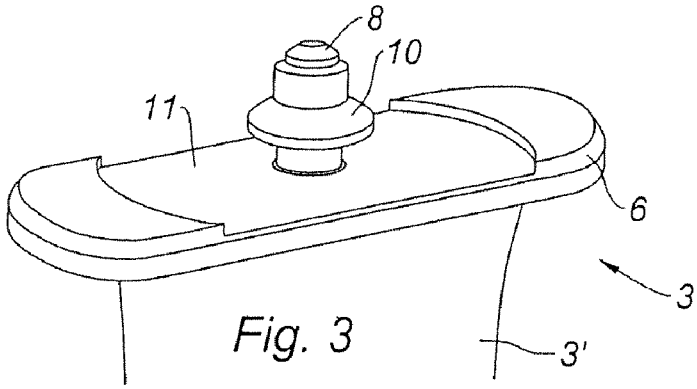
FIG. 3 illustrates a diagrammatic perspective view, seen from outside, of the outer platform of a blade of the preferred embodiment of the blading of the invention.

According to the preferred embodiment of the invention, and with reference to FIG. 3, the platforms 6 comprise, projecting from their outer surface and in a central part of the latter, a threaded rod 8 intended to extend within a bore 9 formed in the wall 5 of the ring 2 and issuing in the flat bottom 7' of the corresponding receptacle 7. A nut 10 is screwed onto the rod 8, here on the outside of the ring 2, the fastening of the blade 3 on the outer ring 2 thus being ensured by bolting.

Since the fastening of the platforms 6 to the ring 2 is ensured by means of the threaded rods 8 projecting out of the surface of the platforms 6 and bolted on the other side of the wall 5 of the ring 2 by means of the nuts 10, no extra thickness for receiving screws attached from outside is necessary here, thus allowing the use of platforms 6 and of a ring 2 of relatively small thickness.

The recesses 7 with a flat bottom 7', which are pierced at their centre with a bore 9 for the passage of a threaded rod 8 secured to the platform 6 to be accommodated, could be compared with countersinks of non-circular form, but complementary to that of the platform 6.

The positioning and orientation of the blades 3 are ensured by the position and orientation of the recesses 7. It is thus possible, with regard to a blading, the blades 3 of which are not oriented in the same way according to their angular position in the crown which they form, that all the blades 3 are identical, their orientation being determined simply by the orientation of the recesses 7 which accommodate them. The recesses 7 perform the function of orienting the blades 3. When a blade 3 is inserted into a receptacle 7, its threaded rod 8 is first inserted into a bore 9, and then the blade 3 comes into place naturally by the walls of its platform 6 bearing on the walls of the corresponding recess 7.

The blading form is both rigid and leak-tight. To be precise, the gas section is delimited on the corresponding part by the ring 2, with the platforms 6 inserted in the receptacles 7. Moreover, the rigidity and the firmness of the mounting of each blade 3 are independent of those of the other blades, since the mounting and fastening of each blade 3 are independent of those of the other blades 3.

Other structures may be envisaged. The blades may be different from one another, depending on their orientation in the crown, the platforms all being identical. This results in a relative simplicity of mounting. Both the blades and the platforms may be different, thus implying that the recesses perform a function of correct assignment, since each type of recess can accommodate only a single type of platform.

In all the instances shown, the mounting of the blades 3 in the blading 1 is ensured with high accuracy, since it depends only on the machining precision of the recesses 7 and of the platforms 6 of the blades 3, not on human factors associated with the quality of the mounting operation itself.

Within the framework of planar contact between the platforms 6 and the flat bottoms 7' of the recesses 7, there is a risk of corrosion by fretting or friction, known as fretting corrosion. In order to reduce this risk, the platforms 6 of the blades 3 comprise a recessed or hollowed-out surface portion 11 around the threaded rod 8. The effect of the presence of such a portion 11 is that contacts between the platform 6 and the flat bottom 7' do not take place on this surface portion 11, which is the zone most subject to friction, but only outside this portion 11.

FIG. 3 shows an embodiment in which this surface portion 11 extends as far as the lateral edges of the platform 6, only the end portions of the platform 6, on each side of the hollowed-out surface portion 11, being in contact with the flat bottom 7'. Other configurations are possible, especially less extensive hollowed-out surface portions 11 limited to the vicinity of the threaded rod 8, the surface of contact with the flat bottom 7' then being a circumferential strip on the platform 6. It may be noted that the depth of the recessed surface portion 11 is not to scale; in actual fact, it is much smaller here.

In a preferred embodiment, the recessed surface portion 11 is of circular form. Such a portion 11 is preferably obtained by the lathe-turning of the platform 6. This machining method has the twofold advantage of, on the one hand, the low costs of implementing it and, on the other hand, its high precision.

The invention claimed is:

1. A turbo-engine stator blading comprising:

a crown of fixed blades mounted on a ring, each blade comprising a platform and each blade is fastened to the ring, wherein the ring comprises a plurality of individual receptacles corresponding to each of the platforms, the receptacles are disposed in an inner circumference of the ring, a shape of each receptacle being complementary to a shape of the corresponding platform such that relative movement between the platform and the ring is prevented when the platform is placed in the corresponding receptacle, wherein the individual receptacles are recesses with a flat bottom, and wherein the platforms of the blades comprise a threaded rod which is inserted into a bore disposed on a surface of the bottom of the corresponding recess and which is bolted to the ring.

2. The stator blading according to claim 1, wherein each of the platforms includes a recessed surface portion around the threaded rod.

3. The stator blading according to claim 2, wherein the recessed surface portion is of circular form.

4. The stator blading according to claim 1, wherein the blades are in one piece with their platform.

5. The stator blading according to claim 1, wherein the receptacles ensure proper positioning and orientation of the blades within the blading.

6. The stator blading according to claim 5, wherein all the blades are identical.

7. A turbo-engine, comprising a stator blading according to claim 1.

8. The turbo-engine according to claim 7, wherein the stator blading is disposed in a compressor of the turbo-engine.

9. The stator blading according to claim 1, wherein lateral edges of adjacent receptacles are separate.

10. The stator blading according to claim 1, wherein the platform includes a plate of substantially constant thickness and a bottom surface of the plate opposite a blade body is flat.

11. The stator blading according to claim 1, wherein the ring includes a zone of abraidable material disposed on the inner circumference of the ring and upstream of the blades.

12. The stator blading according to claim 1, wherein only the threaded rod is inserted into the bore.

13. A blade for a turbo-engine, comprising a blade body; and a platform with a threaded rod projecting from its surface, wherein the platform is formed in one piece with the blade, the platform includes a plate of substantially constant thickness, and a bottom surface of the plate opposite the blade body is flat.

14. The blade according to claim 13, wherein the bottom surface of the platform comprises a recessed portion around the rod.

15. The blade according to claim 13, wherein a length of the platform from an upstream edge to a downstream edge in an axial direction is greater than a length of the blade from an upstream edge to a downstream edge in the axial direction.

* * * * *